US005558501A

United States Patent [19]

Wang et al.

[11] Patent Number: 5,558,501

[45] Date of Patent: Sep. 24, 1996

[54] PORTABLE CEILING FAN

[75] Inventors: Jui-Shang Wang, Taipei, Taiwan; Rodney Jané, Westboro; John Longan, Natick, both of Mass.; Stanley Gresens, Homewood; Gregory Holderfield, Oak Park, both of Ill.; Donald Hootstein, Cambridge, Mass.; Steven R. Valentor, Wesmont, Ill.

[73] Assignee: Duracraft Corporation, Southborough, Mass.

[21] Appl. No.: 398,224

[22] Filed: Mar. 3, 1995

[51] Int. Cl.[6] ..... F04D 29/64

[52] U.S. Cl. ..... 416/244 R; 416/246; 248/159; 248/161; 248/200.1

[58] Field of Search ..... 416/244 R, 246, 416/247 R; 417/423.15; 248/157, 159, 161, 200.1, 354.4

[56] References Cited

U.S. PATENT DOCUMENTS

| | | | |
|---|---|---|---|
| 2,478,829 | 8/1949 | Lechtenberg | 416/247 R |
| 5,273,402 | 12/1993 | Maury | 248/125 |
| 5,403,162 | 4/1995 | Chen | 416/246 |
| 5,411,372 | 5/1995 | Clark | 416/244 R |
| 5,411,373 | 5/1995 | Chiu et al. | 416/246 |

FOREIGN PATENT DOCUMENTS

| | | | |
|---|---|---|---|
| 614821 | 2/1961 | Canada | 248/354.4 |
| 270542 | 5/1927 | United Kingdom | 248/161 |

*Primary Examiner*—James Larson
*Attorney, Agent, or Firm*—John E. Toupal; Harold G. Jarcho

[57] ABSTRACT

A portable electric fan including a plurality of posts connectable to form an elongated pole having first and second ends; a pedestal attached to the first end of the pole and adapted to provide support thereof on a base surface; and a clamp attached to the second end of the pole and adapted for clamping engagement with an upper surface spaced from the base surface. Also included is an adjustment mechanism for adjusting the length of the pole and a blower retained by the pole.

22 Claims, 4 Drawing Sheets

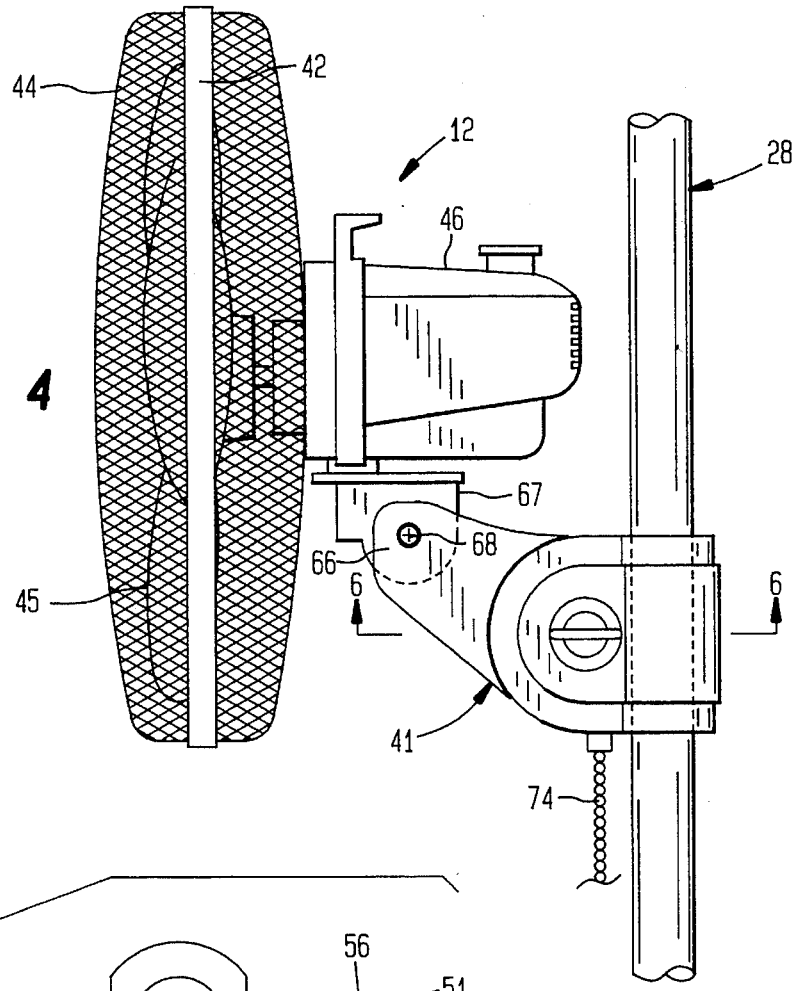
FIG. 4
FIG. 6
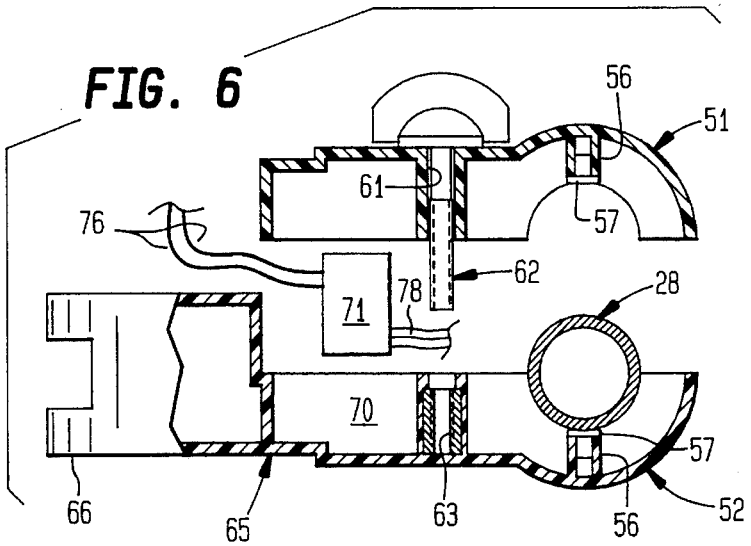
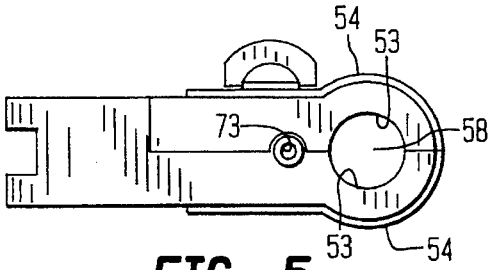
FIG. 5

PORTABLE CEILING FAN

BACKGROUND OF THE INVENTION

This invention relates generally to a portable electric fan and, more particularly, to a portable electric ceiling fan.

Electric fans are used extensively to enhance personal comfort by inducing air flow. During cold periods when heating is employed, ceiling mounted fans circulate hot air in an upper portion of an enclosure downwardly to establish therein a more uniform temperature distribution. Alternatively, during warm weather periods, ceiling mounted fans can create cooling air flow that increases personal comfort in the enclosure. Although providing the desirable functions of increasing personal comfort and reducing heating energy cost, ceiling fans do have certain drawbacks such as high installation costs and minimal airflow adjustability.

The object of this invention, therefore, is to provide an improved electric ceiling fan.

SUMMARY OF THE INVENTION

The invention is a portable electric fan including a plurality of posts connectable to form an elongated pole having first and second ends; a pedestal attached to the first end of the pole and adapted to provide support thereof on a base surface; and a clamp attached to the second end of the pole and adapted for clamping engagement with an upper surface spaced from the base surface. Also included is an adjustment mechanism for adjusting the length of the pole and a blower retained by the pole. The fan is easily mounted in any desired location after use of the adjustment mechanism to establish a pole length equal to the spacing being upper and lower surfaces of an enclosure.

According to one feature of the invention, the adjustment mechanism entails engageable threaded portions on at least a pair of the posts. A desired pole length can be approximated by selecting and interconnecting a predetermined number of threaded posts.

According to another feature of the invention, the adjustment mechanism includes a mechanical jack. Wedging of the pole in a desired position between the spaced apart surfaces is easily accomplished by manipulation of the jack.

According to other features of the invention, the jack includes an internally threaded cylindrical portion of the posts and an externally threaded cylindrical portion of another of the posts, and the one post is rotatably secured to the pedestal. Selective rotation of the one post on the pedestal induces either elongation or contraction of the post.

According to additional features of the invention, the pedestal and the clamp define, respectively, a substantially planar pedestal surface and a substantially planar clamp surface each facing away from the pole. The planar surfaces engage the spaced apart base and upper surfaces to facilitate stable mounting of the fan.

According to further features of the invention, the blower includes a housing, a fan blade retained within the housing, an electric motor retained by the housing and operatively coupled to said fan blade, and a coupling attaching the housing to the pole. Preferably, the coupling is both rotationally and longitudinally adjustable on the pole to facilitate establishment of a desired fan position.

According to a further feature of the invention, the coupling is adapted to permit adjustment of an angular tilt between the housing means and the pole, and includes a securement member for fixing the angular tilt. This feature allows selective orientation of the fan.

According to still other features of the invention, the fan includes a power cord connected to the electric motor, at least one clip for fixing the power cord to the pole, an on-off electrical switch retained by the blower and operatively connected to the electric motor, and an elongated flexible actuator operatively connected to the switch and extending downwardly from the blower. The power cord and clip facilitate convenient mounting of the fan as a ceiling unit and the actuator permits manual activation of the fan after mounting.

DESCRIPTION OF THE DRAWINGS

These and other objects and features of the invention will become more apparent upon a perusal of the following description taken in conjunction with the accompanying drawings wherein:

FIG. 4 is a side elevational view of blower and coupling portions of the fan shown in FIG. 1;

FIG. 5 is a bottom view of the coupling portion shown in FIG. 4;

FIG. 6 is a cross sectional view taken along lines 6—6 of FIG. 4.

DESCRIPTION OF THE PREFERRED EMBODIMENT

Figure 1:
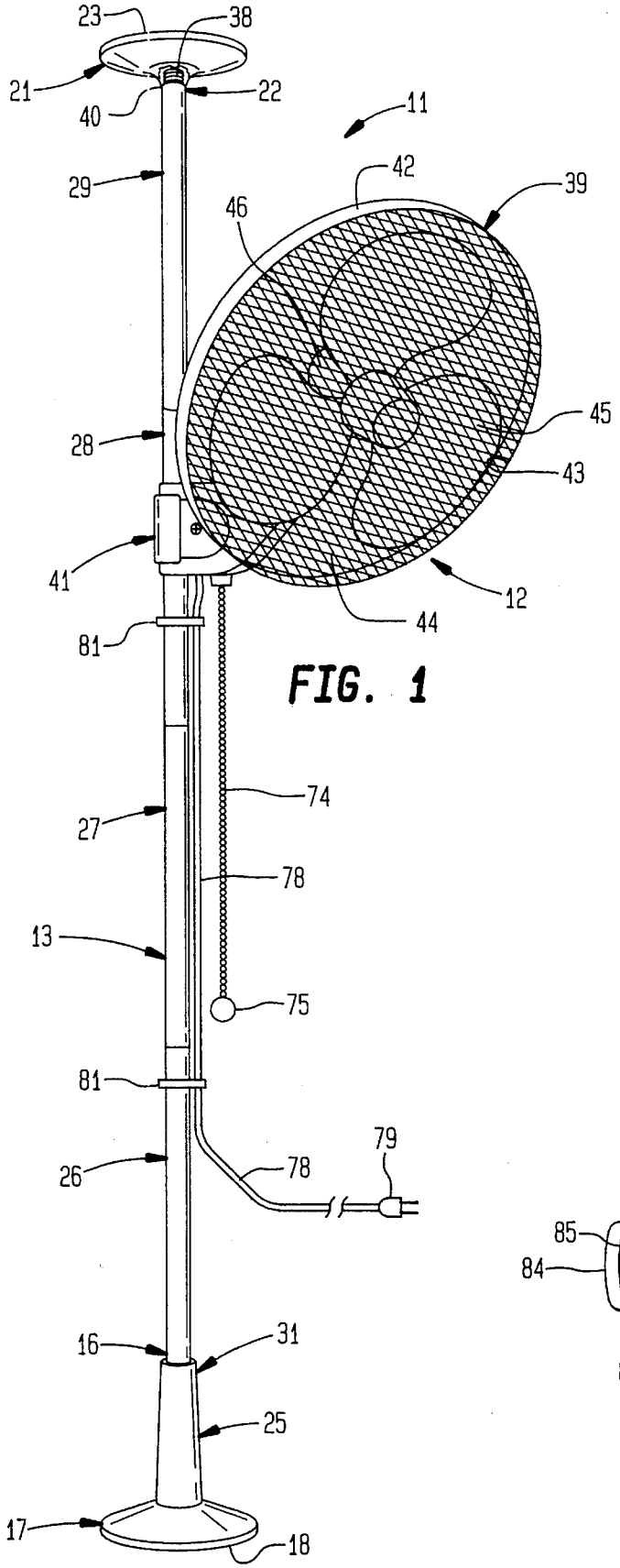
FIG. 1 is a perspective view of a portable ceiling fan according to the invention.

A portable electric fan 11 includes a blower 12 supported on a pole assembly 13. Attached to a first end 16 of the pole assembly 13 is a circular pedestal plate member 17 having a support surface 18 facing away from the pole assembly 13 for supportive engagement with a suitable base surface such as a floor. A circular clamp member 21 is attached to an upper second end 22 of the pole assembly 13 and has a planar clamp surface 23 facing away therefrom for pressured engagement with a suitable upper surface such as a ceiling spaced from the base surface supporting the pedestal member 17.

Figure 2:
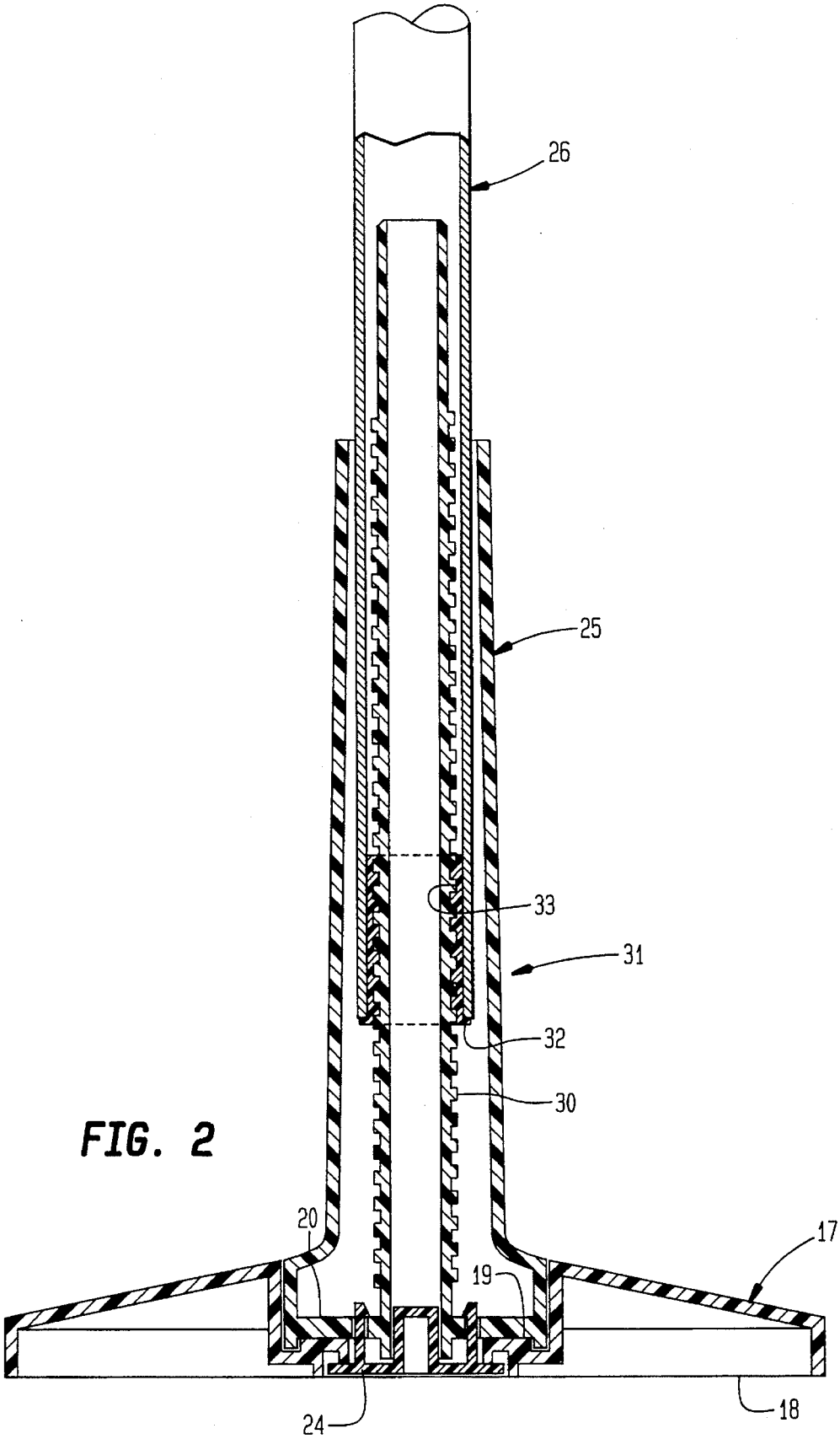
FIG. 2 is a cross-sectional view of a jack portion of the fan shown in FIG. 1.

The pole assembly 13 is formed by a plurality of longitudinally aligned tubular posts 25–29. One of the posts 25 combines with another adjacent post 26 to form a mechanical jack 31 operable to adjust the length of the pole assembly 14. The post 25 has a bottom wall 20 rotatably mounted on an annular bearing surface 19 defined by a central recess in the pedestal member 17 (FIG. 2). Rotatably securing the wall 20 to the pedestal member 17 is a clip 24. An externally threaded jack screw 30 extends upwardly from the bottom wall 20 and within the cylindrical post 25. Engaging the jack screw 30 are internal threads 33 on a cylindrical plastic insert 32 secured within a lower end 35 of the tube 26.

Figure 3:
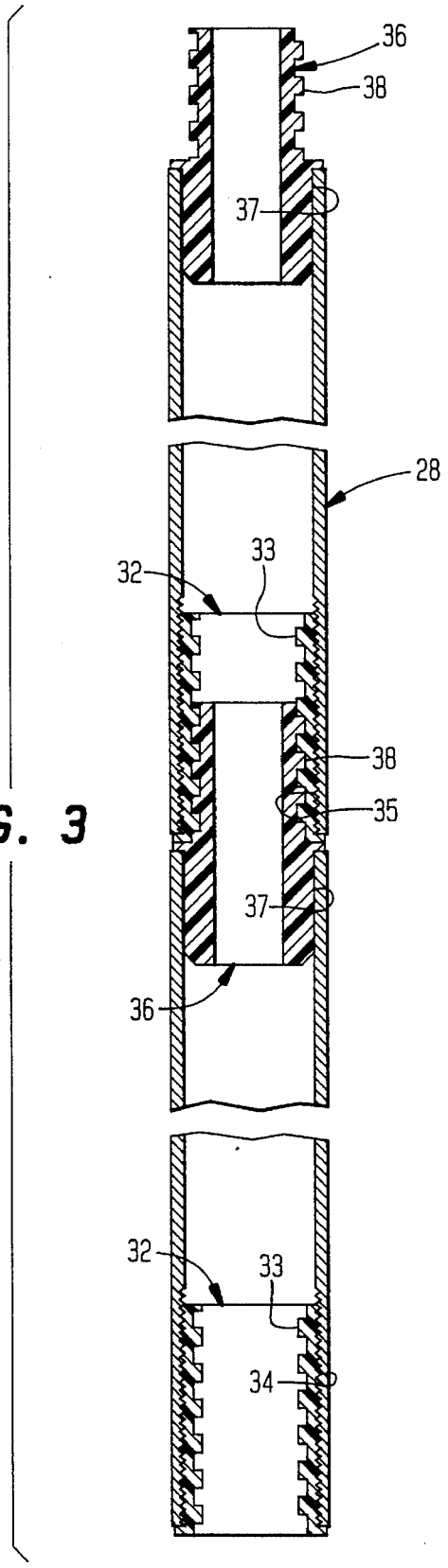
FIG. 3 is a cross sectional view of a post joint portion of the fan shown in FIG. 1.

A lower end 35 of each tube 27–29 retains one of the cylindrical inserts 32. Selectively engageable with the insert 32 in each tube 27–29, respectively, is a cylindrical plastic insert 36 (FIG. 3) press fitted into an upper end of a joined tube 26–28 having a portion 37 press fitted into an upper end of a joined tube 26–28. Extending longitudinally from each portion 37 is an externally threaded portion 38 that engages an inner portion 35 of an insert 32 in an adjoining tube. The clamp member 21 projects transversely from the tube 29 and has an internally threaded socket 40 that receives an externally threaded portion of an insert 36 in the tube 29.

The blower assembly 12 includes a housing 39 and a coupling mechanism 41 attaching the housing 39 to the pole 13. Forming the housing 39 is a cup shaped member 42 having an open end 43 covered by a circular grill 44. Retained within the housing 39 is a fan blade 45 for discharging air through the grill 44. Also retained by the housing 39 is an electric motor 46 operatively coupled to the fan blade 45.

As shown in FIGS. 4–6, the coupling mechanism 41 includes a pair of mated parts 51, 52, each defining an internally directed semi-circular surface 53. Extending inwardly from outer wall portions 54 of each part is a pin 56 that terminates with a resilient cap 57. The surfaces 53 form a circular opening 58 partially bounded by the caps 57 and accommodating the post 28. Inserted into an opening 61 in the part 51 is screw 62 that engages an internally threaded insert 63 retained by the part 52. Manual tightening of the screw 62 within the insert 63 draws the parts 51, 52 together and presses the resilient caps 57 against the post 28 to securely fix thereon the coupling 41. Formed by an extension portion 65 of the part 52 is a yoke 66 that retains a bracket 67 supporting the motor 46. A retainer pin 68 extends through the bracket 67 and the bifurcated portions of the yoke 66 and allows relative pivotal movement therebetween so as to adjust angular tilt between the housing 39 and the pole assembly 13, and then fixedly secure the housing in a selected angular tilt position.

Figure 7:
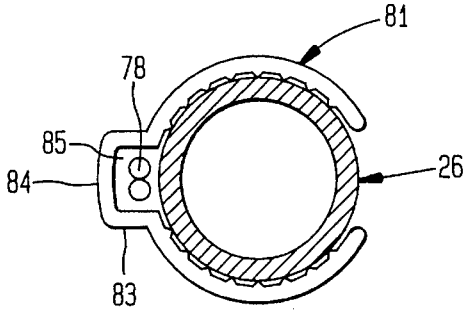
FIG. 7 is a cross sectional view illustrating a power cord clamp for the fan shown in FIG. 1.

Retained within a hollow chamber 70 formed between the parts 51, 52 is an electrical on-off switch 71. An elongated flexible actuator chain 74 extends through an opening 73 in the bottom of the coupling 41. One end of the chain 74 is operatively coupled to the on-off switch 71 and an opposite end is attached to a knob 75 hanging below the blower assembly 12. The on-off switch is electrically connected by leads 76 to the electric motor 46 and to a power cord 78 that terminates with a plug 79 for insertion into a conventional electrical outlet (not shown). Fixing the power cord 78 to the pole assembly 13 are a plurality of clips 81. Each of the clips 81, is a split ring formed of a suitable flexible material that allows expansion to facilitate placement around one of the posts 25–29 as shown in FIG. 7. Mid-portions of each clip ring 81 have radially outwardly directed portions 83 joined to circumferentially directed portions 84. Together the radial portion 83 and circumferential portion 84 form a recess 85 for retaining the electrical power cord 78.

Prior to use, the portable electric fan 11 is transported to a selected position within an enclosure in which air circulation is desired. A predetermined number of the engaged posts 26–29 then are joined with the jack posts 25, 26 to establish for the pole 13 a length that approximates the spacing between vertically spaced apart base and upper surfaces (not shown) such as a floor and ceiling of the enclosure. After vertical positioning of the pole between those surfaces, the post 25 (FIG. 2) is rotated on the pedestal member 17 in a direction to produce outward movement of the jack post 26 and elongation of the pole assembly 13 until the planar clamp member 21 moves into pressured engagement with the upper surface of the enclosure.

Desired longitudinal height and rotational angular positions of the housing 39 are established by, respectively, sliding and rotating the coupling mechanism 41 on a selected post of the pole 13, after which the latching screw 62 is manually tightened to fix those selected positions. Similarly, the bracket 67 (FIG. 4) is pivoted in the yoke 66 to establish a selected angular tilt position of the housing 39. Pursuant to stable mounting and selective orientation of the portable fan 11 in the manner described above, the handle 75 on the actuator chain 74 can be pulled to induce either energization or deenergization of the electric motor 46 and the operatively coupled fan blade 45.

Obviously, many modifications and variations of the present invention are possible in light of the above teachings. It is to be understood, therefore, that the invention can be practiced otherwise than as specifically described.

What is claimed is:

1. A portable electric fan comprising:

a plurality of posts adapted for interconnection to form an elongated pole means having first and second ends, each of said posts having threaded portions accommodating said interconnection of said posts;

a pedestal attached to said first end of said pole means and adapted to provide support thereof on a base surface;

clamp means attached to said second end of said pole means and adapted for clamping engagement with an upper surface spaced from said base surface;

an adjustment mechanism for adjusting the length of said pole means; and blower means retained by said pole means.

2. A fan according to claim 1 wherein said adjustment mechanism comprises a mechanical jack for lifting said pole means.

3. A fan according to claim 1 including coupling means securing said blower means to said pole means and longitudinally adjustable thereon.

4. A portable electric fan comprising:

a plurality of posts adapted for interconnection to form an elongated pole means having first and second ends;

a pedestal attached to said first end of said pole means and adapted to provide support thereof on a base surface;

clamp means attached to said second end of said pole means and adapted for clamping engagement with an upper surface spaced from said base surface;

an adjustment mechanism for adjusting the length of said pole means, said adjustment mechanism comprising a mechanical jack for lifting said pole means; and blower means retained by said pole means.

5. A fan according to claim 4 wherein said jack provides a lifting mechanical advantage.

6. A fan according to claim 5 wherein said jack comprises an internally threaded cylindrical portion of one of said posts and an externally threaded cylindrical portion of another of said posts rotatably mounted on said pedestal.

7. A fan according to claim 6 wherein said another post is a tube member rotatably secured to said pedestal and having an externally threaded, internal jack screw engaging said one post.

8. A fan according to claim 7 wherein said pedestal and said clamp means define, respectively, a pedestal support surface and a clamp surface each facing away from said pole means.

9. A fan according to claim 8 wherein said blower means comprises housing means, a fan blade retained within said housing means, an electric motor retained by said housing means and operatively coupled to said fan blade, and coupling means attaching said housing means to said pole means.

10. A portable electric fan comprising:

a plurality of posts adapted for interconnection to form an elongated pole means having first and second ends;

a pedestal attached to said first end of said pole means and adapted to provide support thereof on a base surface;

clamp means attached to said second end of said pole means and adapted for clamping engagement with an upper surface spaced from said base surface;

an adjustment mechanism for adjusting the length of said pole means;

blower means retained by said pole means; and coupling means securing said blower means to said pole means and longitudinally adjustable thereon.

11. A fan according to claim 10 wherein each of said posts comprises threaded portions accommodating said interconnection of said posts.

12. A fan according to claim 10 wherein said posts have uniform outer surfaces that mate to provide said pole means with a substantially smooth exterior surface that accommodates movement of said coupling means between said posts.

13. A fan according to claim 12 wherein said coupling means is rotationally adjustable on said pole means.

14. A fan according to claim 13 wherein said coupling means includes latch means manually operable to establish a fixed relative position of said coupling means on said pole means.

15. A fan according to claim 14 wherein said coupling means is adapted to permit adjustment of an angular tilt between said blower means and said pole means.

16. A fan according to claim 15 wherein said coupling means further comprises securement means for fixing said angular tilt.

17. A fan according to claim 16 wherein said blower means comprises an electric motor and including a power cord connected to said electric motor, and clip means for fixing said power cord to said pole means.

18. A fan according to claim 17 including an on-off electrical switch retained by said coupling means and operatively connected between said electric motor and said power cord, and an elongated flexible actuator means operatively connected to said switch and extending downwardly from said coupling means.

19. A fan according to claim 12 wherein said blower means comprises an electric motor and including an on-off electrical switch retained by said coupling means and operatively connected to said electric motor, and an elongated flexible actuator means operatively connected to said switch and extending downwardly from said coupling means.

20. A fan according to claim 19 including a power cord connected to said electric motor, and clip means for fixing said power cord to said pole means.

21. A fan according to claim 12 wherein said posts are hollow cylinders with outer surfaces of uniform diameter, and at least one of said posts has a reduced diameter end portion received by an adjacent said post.

22. A portable electric fan comprising:

a plurality of posts adapted for interconnection to form an elongated pole means having first and second ends;

a pedestal attached to said first end of said pole means and adapted to provide support thereof on a base surface;

clamp means attached to said second end of said pole means and adapted for clamping engagement with an upper surface spaced from said base surface;

an adjustment mechanism for adjusting the length of said pole means;

blower means retained by said pole means; said blower means comprising a housing means, a fan blade retained within said housing means, an electric motor retained by said housing means and operatively coupled to said fan blade, and coupling means attaching said housing means to said pole means;

an on-off electrical switch retained by said coupling means and operatively connected to said electric motor;

an elongated flexible actuator means operatively connected to said switch and extending downwardly from said coupling means;

a power cord connected to said electric motor; and clip means for fixing said power cord to said pole means.

* * * * *